United States Patent [19]

Savard, Jr.

[11] 4,349,127

[45] Sep. 14, 1982

[54] DEVICE FOR AFFIXING GARMENTS ONTO HANGERS

[75] Inventor: Hassel J. Savard, Jr., Neshanic, N.J.

[73] Assignee: Atron, Inc., Rahway, N.J.

[21] Appl. No.: 74,324

[22] Filed: Sep. 11, 1979

[51] Int. Cl.[3] ..... B65H 3/00; B65G 59/00

[52] U.S. Cl. ..... 221/196; 221/239; 221/256; 221/274

[58] Field of Search ..... 221/194, 195, 196, 268, 221/272, 273, 274, 275, 271, 276, 239, 255-257; 312/42, 60; 223/88, 111; 211/490

[56] References Cited

U.S. PATENT DOCUMENTS

| | | | |
|---|---|---|---|
| 2,819,819 | 1/1958 | Warren | 221/256 |
| 2,917,203 | 12/1959 | Hardin | 221/195 |
| 2,919,051 | 12/1959 | Wideburg et al. | 221/195 X |
| 3,110,415 | 11/1963 | Robbins et al. | 221/195 X |
| 3,762,602 | 10/1973 | Wasil | 221/195 |
| 3,915,313 | 10/1975 | Thur et al. | 221/195 X |
| 3,917,112 | 11/1975 | Willis et al. | 221/195 X |

FOREIGN PATENT DOCUMENTS

| | | | |
|---|---|---|---|
| 211552 | 7/1909 | Fed. Rep. of Germany | 221/195 |

*Primary Examiner*—Allen N. Knowles
*Attorney, Agent, or Firm*—Bucknam and Archer

[57] ABSTRACT

A device for holding a stack of hangers and for advancing one hanger at a time from the stack to a forward position and for carrying out a predetermined operation, usually the affixing of garments, when in the forward position, is described. The device comprises a vertical frame for holding the hangers, a main plate essentially perpendicular to the frame and intersecting the frame in an essentially cross configuration, a receptacle for the hanger resting on the main plate. The receptacle is slidable from a forward position to a rearward position and vice versa. An electric motor provided with a cam linkage permits to carry out automatically the steps of advancing and retracting the receptacle. The method of operation is also described.

13 Claims, 10 Drawing Figures

FIG. 4A
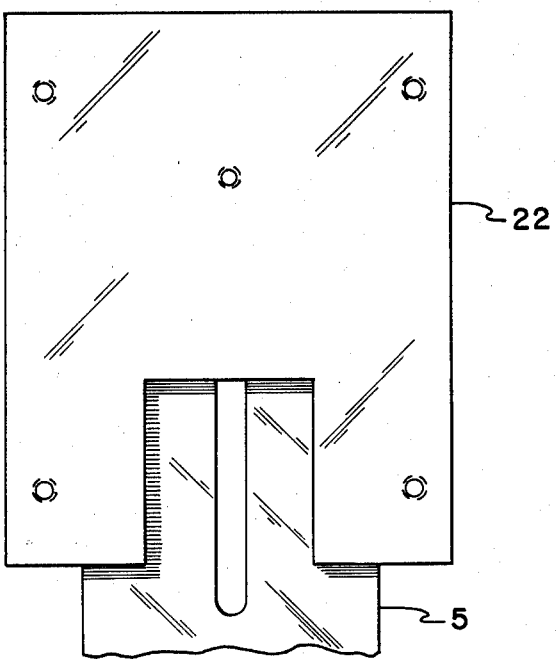
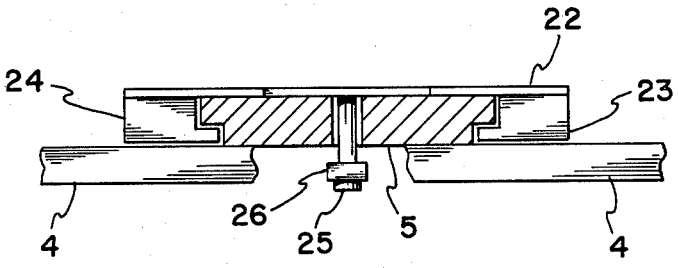
FIG. 4B $P_1$ POWER PLUG $S_1$ POWER ON SWITCH $F_1$ FUSE , 3A $L_1$ ON LAMP $K_1$ PRIMARY (REMOTE RELAY)

$K_{1-1}$ CONTACT (REMOTE RELAY)

$K_R$ SECONDARY (REMOTE RELAY)

$S_H$ HANGER SWITCH $M_1$ MOTOR

DEVICE FOR AFFIXING GARMENTS ONTO HANGERS

The present invention relates to devices for holding a plurality of articles and feeding one article at a time for the operation to be carried out with the articles. More specifically the present invention relates to hangers and to the operation of affixing garments onto hangers.

It is common knowledge that most garments are shown in stores on hangers and this is true not only with outerwear, such as coats, jackets, blouses, skirts but also underwear including pants, girdles, brassieres, slips, etc. The time and labor involved at the manufacturing plant in the operation of taking each hanger, affixing the garment thereon and placing the hanger with the garment affixed thereon in a suitable place where all the hangers may be stored, constitute a very serious drawback.

An object of the present invention is to provide a device which permits to stack the hangers, preferably vertically, hold the stack and when the operator is ready for the operation of affixing the garments thereon, feed the hangers one by one in position suitable for carrying out the operation. After one hanger with the garment affixed thereon is removed, the device of the present invention permits to feed the next hanger, and so on.

The invention also provides a method for holding a stack of hangers, preferably vertically, presenting the hanger one by one to an advanced position in front of the operator and affixing the garments thereon with substantial saving in time and labor.

According to preferred embodiments of the present invention, the steps of removing one hanger at a time from the stack, feeding each hanger to a forward position suitable for the operation to be carried out on a platform and retracting the platform to receive another hanger, are performed automatically. A substantial advantage in time and labor is achieved with the device of this invention. Further, it is not necessary for the operator to use any manual force in the step of removing one hanger from the stack and in the preferred embodiments of the present invention also in the step of presenting the hanger to a position in front of the operator. More specifically, with the device of the present invention at least in one of the preferred embodiments, the steps of removing the hanger from the stack, placing the hanger onto a suitable receptacle, advancing the receptacle to a forward position and after the operation is completed and the hanger is removed, retracting the receptacle to the rear position and letting another hanger be seated in the receptacle, are carried out automatically. According to a preferred embodiment of the invention, an electric motor is used to provide the energy required to advance the hangers to the forward position.

The invention will now be described by reference to the accompanying drawings of which:

FIGS. 4A and 4B illustrate the hanger feed slide mechanism;

Figure 5A:
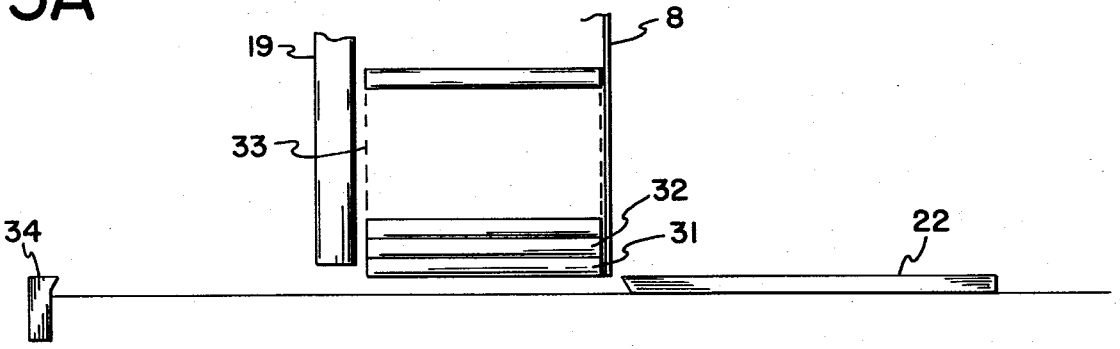
Figure 5B:
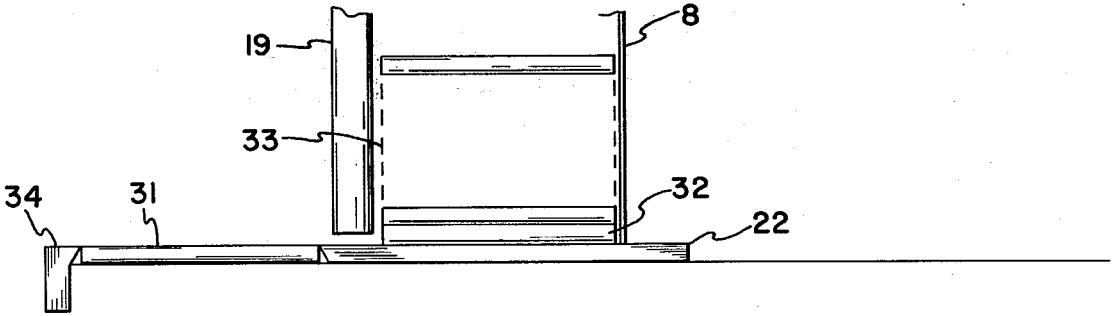
Figure 5C:
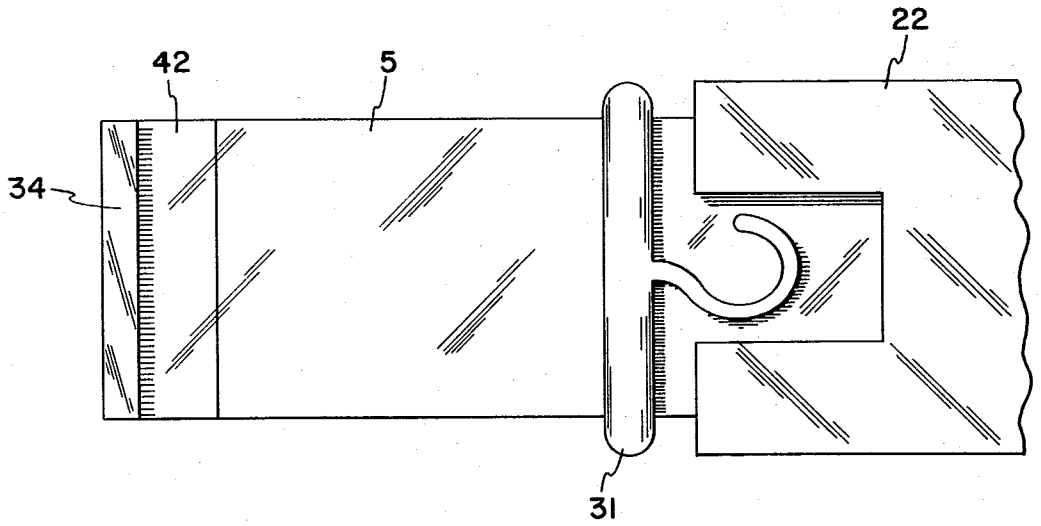
Figure 6:
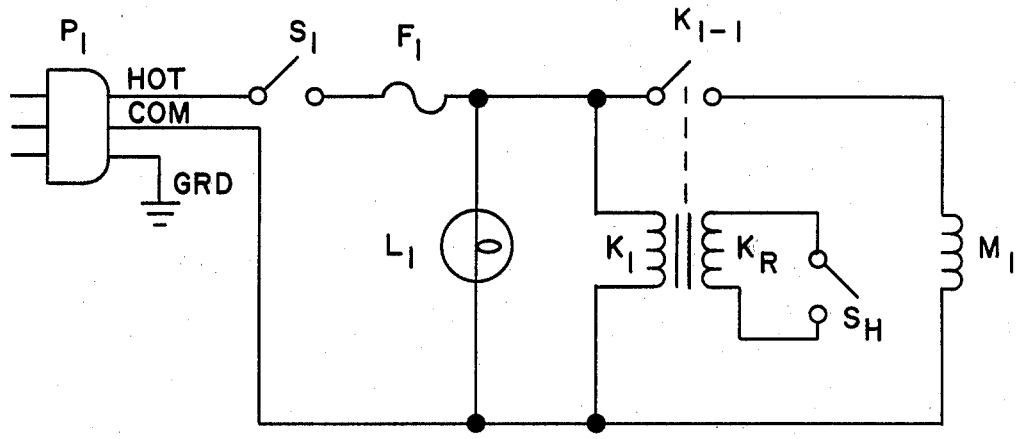

FIGS. 5A, 5B, and 5C illustrate the hanger being dropped into the receptacle;

FIG. 6 illustrates schematically the electrical connections involved in the embodiment of FIG. 1–5.

Figure 1A:
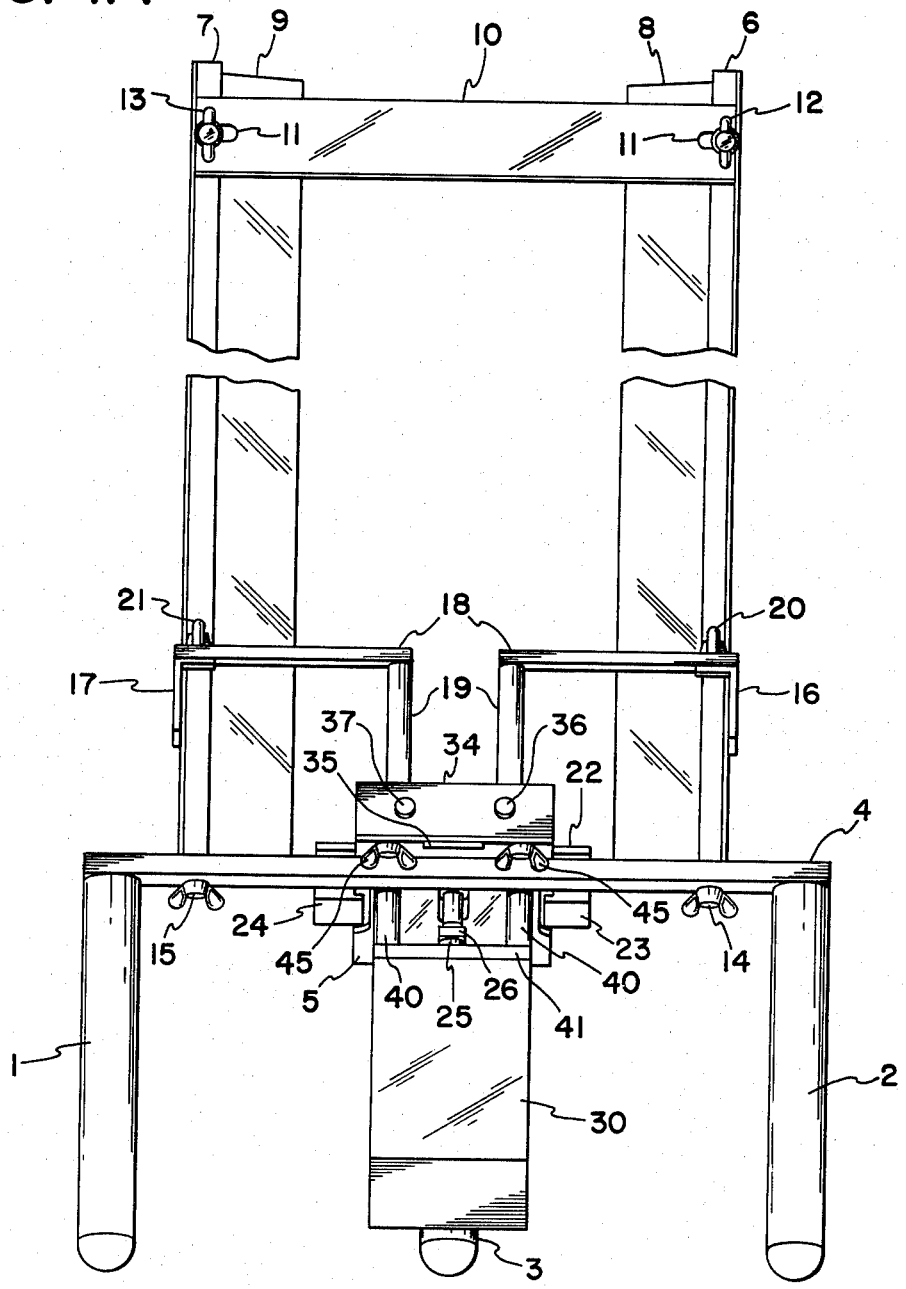
FIG. 1(A) illustrates a front view one embodiment of the device of this invention.
Figure 1B:
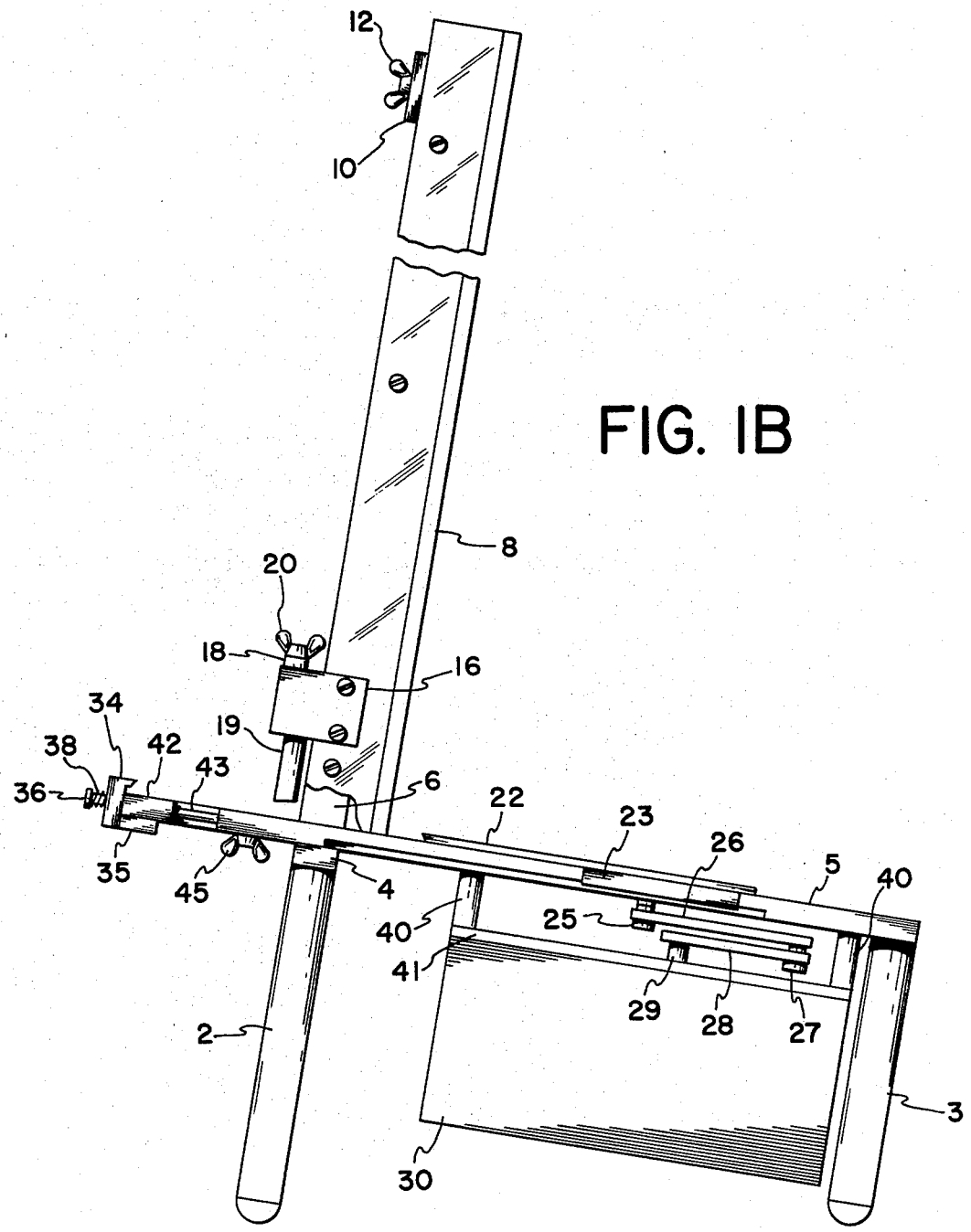
FIG. 1(B) illustrates a side view of the device of this invention.
Figure 2:
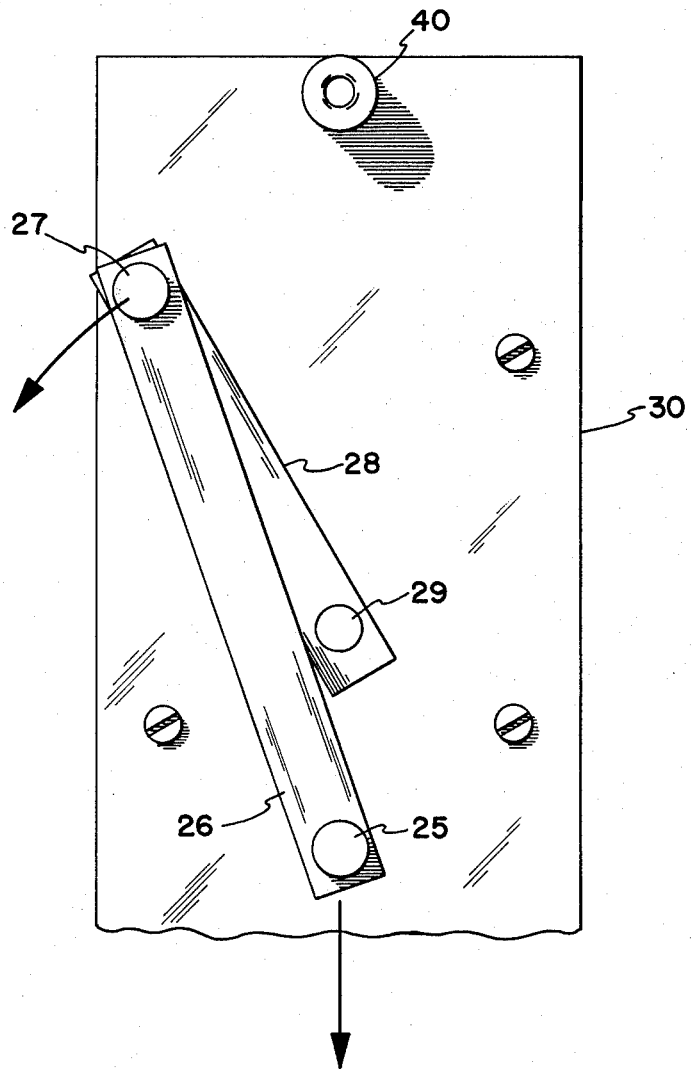
FIG. 2 illustrates the motor drive mechanism.

By reference to FIG. 1A, FIG. 1B, and FIG. 2 and 2 the device of the present invention comprises a frame which is supported, advantageously for instance, by two front legs 1 and 2 and one rear leg 3. As shown in FIG. 1 legs 1 and 2 are affixed to the horizontal slide mount 4.

The frame also comprises hanger side bars 6 and 7 and cross slide mount 4. Preferably the hanger side bars 6 and 7 are movable outwardly to fit hangers of greater size. The frame also comprises vertical hanger back rests 8 and 9 which are connected to the hanger side bars 6 and 7 which prevent the hangers from falling backward. Numeral 10 designates a spacer bar which stabilizes the hanger side bars 6 and 7. Numerals 12 and 13 designate wing bolts which are used to engage into slots 11 for the purpose of adjusting the width of the frame. It is clear, however, that other means could be used instead of wing bolts for the adjustment of the width of the frame.

Numerals 14 and 15 designate wing bolts which engage with slots in the cross slid mount 4 and which are also used to provide for adjusting the width of the frame. Numerals 16 and 17 designate forward stop bar mounts which are attached to the hanger side bars 6 and 7 and provide a mounting platform for the stop bar mounting arms 18. Stop bars 19 are attached to the arms 18 as shown in FIGS. 1(A) and 1(B).

Wing bolts 20 and 21 engage with slots in the stop mounting arms 18 and provide for adjustment inwardly and from the front to the rear position. Numeral 5 designates a cross slide which is affixed to the cross slid mounting arm 4. Cross slide 5 has a slide plate 22 resting on it. Numerals 23 and 24 designate retainers. By engagement of the cross slide 5 and retainers 23 and 24, the slide plate 22 may move forwardly and may also retract to a rear position. A slot cut in the cross slide 5 in the front to the back direction provides access to the slide plate 22 by means of the feed plate post 25 which engages connection link 26.

As shown in FIG. 1(B) and FIG. 2 link 26 is part of a cam linkage. Numeral 30 in FIG. 1(B) designates the motor. The end of connecting link 26 which is opposite to the feed plate post 25 engages pivot pin 27 which is mounted to the drive arm 28. The drive arm 28 is mounted on the motor shaft 29. When the motor 30 is energized, the shaft 29 rotates. Due to the cam linkage formed by link 26 and drive arm 28, the rotation is converted to a forward or backward motion. More specifically, this forward or backward motion results due to the relationship of the drive arm 28, the connecting link 26, the slide plate 22 with the retainers 23 and 24 which engage tracks in the cross slide 5. Numeral 40 designates motor mount posts and numeral 41 designates motor mount which serve to locate the motor in the proper position under the cross line 5.

Referring to FIGS. 5A and 5B, the stack of hangers is illustrated by numerals 31, 32, 33 . . . etc. In the embodiment illustrated in these figures the hangers are laying flat and one hanger is superimposed over the other so as to form a vertical stack. FIG. 5(A) illustrates the slide plate 22 in the retracted position with the lowermost hanger 31 ready to drop into the slide plate 22. The slide plate 22 serves as a receptacle for the hanger because it has a cut-out in the front portion of a shape suitable to hold one hanger in place. Although it is not necessary that the cut-out have a shape identical to the hanger, the shape of the cut-out should be such that at least the hook portion or the two side arms be held properly in place.

When the slide plate 22 has retracted to the rearmost travel by action of the motor 30, drive arm 28 and connecting link 26, the hanger 31 drops into the cut out in the slide plate 22. The hanger held in place on the slide plate 22 is then brought in the forward position because the slide plate slides under the stop bar 19, thus permitting only one hanger from the stack of hangers to be removed. Essentially the lowermost hanger drops into the cut-out by force of gravity but the slide plate retracts by operation of the cam linkage connected with the motor.

The slide plate then advances to the forward position at which point the hanger engages the front stop 34 and is held in position during the period of time during which the operator affixes the garment onto the hanger.

After the operation of affixing the garment to the hanger is terminated, the hanger is removed and the contact with the front stop 34 is broken. The slide plate travels rearwardly and the next hanger to be fed, designated by numeral 32, now rests on top of the slide plate 22, as shown in FIG. 5B. It should be noted that at the beginning of the rearward travel of the slide plate 22, hanger 32 is prevented from moving by the hanger back rest 8. When the slide plate 22 reaches the rearmost position of travel hanger 32 drops into the cut-out in the slide plate 22 and the process is repeated. To provide a brake, a sensing switch 35 is provided (see FIGS. 1(B) and 3). This switch is actuated by motion of the front stop 34 which moves on pins 36 and 37 and is restrained by springs 38 and 39 (see FIG. 3). When the hanger is seated against the front stop 34 as shown in FIG. 5(B), a small motion of the front stop 34 occurs and the switch 35 is actuated. At this point rotation of the motor 30 stops and no rotation of the motor occurs until the hanger is removed. When the hanger is lifted by a slight upward motion from the slide plate, the motor will start operating again and the operation is repeated with each one of the hangers from the bottom of the stack.

Figure 3:
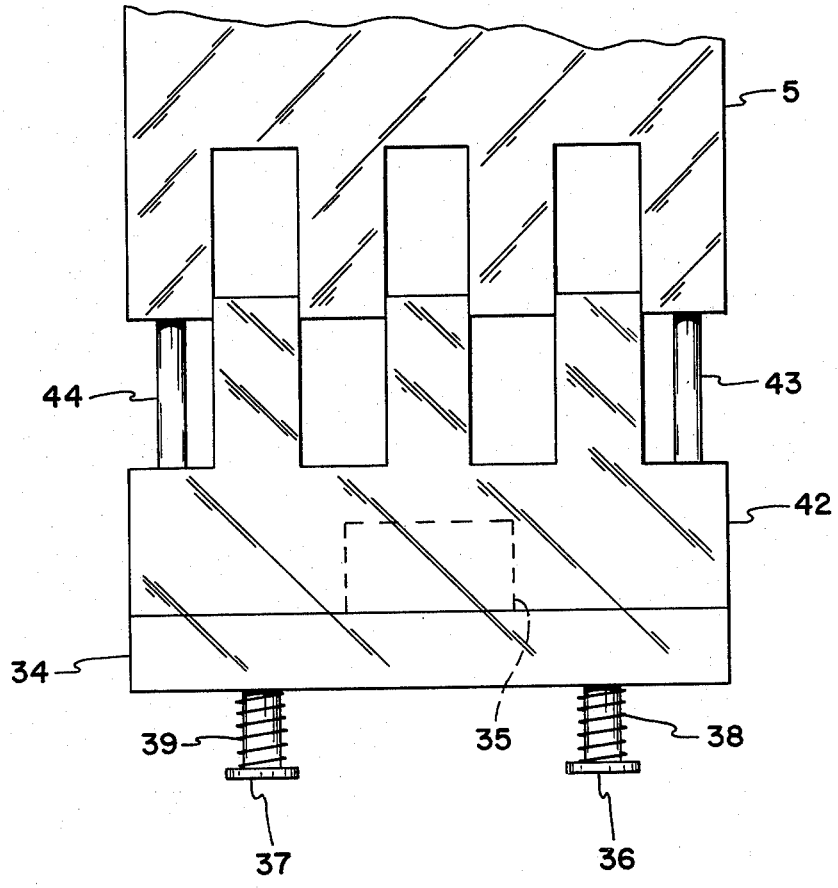
FIG. 3 illustrates the nose and motor stop control mechanism which are adjustable.

As shown in FIG. 3, the device is capable of adjusting to a different height of hangers because the nose 42 of the cross slide 5 is adjustable by means of pins 43 and 44 and wing bolt 45. The nose 42 together with the hanger sensing mechanism 35 and 34 moves inwardly to accommodate for a different height hangers against the fixed stroke of the slide plate 22.

The device illustrated hereinabove in FIGS. 1–5 requires a simple electrical mechanism as illustrated in more detail in FIG. 6 in which $P_1$ is a power plug, $S_1$ is a power-on switch, $F_1$ is fuse, 3A, $L_1$ is on lamp, $K_1$ is primary (remote relay), $K_{1-1}$ *is contact (remote relay), K2* is secondary (remote relay), SH is hanger switch and $M_1$ is motor.

The device described hereinabove permits to carry out all the steps of holding the hangers in the stack, feeding the hangers one at a time, carrying out the operation of affixing the garment onto the hanger and retracting slide plate to the rearward position and repeating the steps with the next lowermost hanger by a minimum of manual force because the only manual force required is in the actual operation of affixing the garment onto the hangers and then removing them from the hangers. All the steps as described hereinabove are carried out by the cam linkage connected with the motor and by proper selection of the shape of the cut-out portion in the slide plate so that each hanger drops into it by gravity.

Although the device has been illustrated with hangers, it is manifest that it could be used in connection with a variety of articles which ordinarily require manual force for simple industrial operations, for instance handles of pails, bags, etc. Also if it is desired to eliminate the electric motor, springs may be used or pneumatic means to retract the slide plate.

What is claimed is:

1. A device for holding a stack of hangers and for advancing one hanger at a time from said stack to a forward delivery position and for affixing a garment onto the hanger when in the forward hanger delivery position, which comprises a frame for holding said hangers, a main plate essentially perpendicular to said frame intersecting said frame in an essentially cross configuration, a slide for said hanger resting on said main plate, said slide being slidable from said forward hanger delivery position to a rearward hanger receiving position and vice versa and the device further comprises means for holding said stack of hangers on said frame and for releasing one hanger at a time from said stack and causing said hanger to be seated in said slide, said hanger being movable from said rearward hanger receiving position to the forward delivery position along a support guide means which supports the hanger at the delivery position to allow the affixing of a garment onto the hanger, and means for holding the hanger at the forward delivery position during the operation of affixing the garment.

2. The device according to claim 1 wherein said stack of hangers is essentially vertical, the frame is essentially vertical and the lowermost hanger is removed each time and drops into said slide under the force of gravity.

3. The device according to claim 2 wherein the frame is slightly inclined and said main plate is slightly inclined and intersects said frame.

4. The device according to claim 1 wherein said slide is a slider plate resting on said main plate, said slider plate having a cut-out front portion which serves as a receptacle for said lowermost hanger.

5. The device according to claim 4 wherein said stack of hangers rests on the rear portion of said slider plate when the lowermost hanger is seated in the cut-out portion of said slide.

6. The device according to claim 4 which comprises actuating means for advancing said slide from the rearward position to the forward position and vice versa, said actuating means being operative after said article is removed.

7. The device according to claim 6 wherein said actuating means are electric means.

8. The device according to claim 7 wherein said electric means comprises a motor provided with a cam linkage and switching means, said switching means make contact with said hanger during said operation, and after the hanger is removed, said cam linkage causes said slide to retract to the rearward position.

9. The device according to claim 2 wherein said frame is of adjustable width.

10. The device according to claim 8 which comprises a front stop for contacting the hanger and holding the hanger in the forward delivery position, a switch actuated by said front stop, said switch, when actuated stopping the rotation of the motor during the operation of affixing the garment, the contact with said stop being broken and said switch becoming inoperative when the hanger is removed whereby rotation of the motor is restored and said slide retracts to said rearward receiving position for receiving the next lowermost hanger.

11. The device according to claim 6 wherein said actuating means are springs.

12. The device according to claim 6 wherein the actuating means are pneumatic means.

13. The device according to claim 2 wherein each of the hangers is in an essentially horizontal position in said stack and each hanger is supported at the forward delivery position in an essentially horizontal position.

* * * * *